US005819862A

United States Patent [19]

Matthias et al.

[11] Patent Number: 5,819,862

[45] Date of Patent: Oct. 13, 1998

[54] DOWNHOLE COMPONENTS FOR USE IN SUBSURFACE DRILLING

[76] Inventors: Terry R. Matthias, 17 Penny Close, Longlevens, Gloucestershire; John Hayward, Hydewood House, Cirencester Road, Minchinhampton, Gloucestershire; Haydn Richard Lamb, The Plough Inn, Longdon, Nr. Tewkesbury Gloucestershire, all of England

[21] Appl. No.: 618,657

[22] Filed: Mar. 19, 1996

[30] Foreign Application Priority Data

Mar. 22, 1995 [GB] United Kingdom ..... 9505783

[51] Int. Cl.[6] ..... E21B 10/56

[52] U.S. Cl. ..... 175/428; 175/432

[58] Field of Search ..... 175/399, 408, 175/426, 428, 432, 431

[56] References Cited

U.S. PATENT DOCUMENTS

| | | | |
|---|---|---|---|
| 4,109,737 | 8/1978 | Bovenkerk | 175/430 |
| 4,255,165 | 3/1981 | Dennis et al. | 51/309 |
| 4,473,125 | 9/1984 | Addudle et al. | 175/426 |
| 4,512,425 | 4/1985 | Brock | 175/430 |
| 4,545,441 | 10/1985 | Williamson | 175/431 |
| 4,811,801 | 3/1989 | Salesky et al. | 417/454 |
| 5,131,478 | 7/1992 | Brett et al. | 175/57 |
| 5,351,770 | 10/1994 | Cawthorne et al. | 175/426 X |
| 5,467,836 | 11/1995 | Grimes et al. | 175/408 X |

FOREIGN PATENT DOCUMENTS

| | | | |
|---|---|---|---|
| 1343040 | 1/1974 | United Kingdom | 175/432 |
| 2041427 | 9/1980 | United Kingdom | 175/426 |
| 2289909 | 12/1995 | United Kingdom . | |
| 9533911 | 12/1995 | WIPO . | |

*Primary Examiner*—David J. Bagnell

[57] ABSTRACT

In a rotary drag-type drill bit, or other downhole component used in subsurface drilling, bearing pads which engage the surface of the earthen formation of the borehole carry wear-resistant bearing inserts received in sockets in the bearing pad. Each bearing insert includes a preform element of the kind normally used as cutting elements in drag-type drill bits, and having a front facing table of polycrystalline diamond bonded to a less hard substrate. The preform element is orientated so that its front diamond surface is tangential to the surface of the bearing pad, or at a slight angle thereto, so as to provide a highly wear-resistant, but non-aggressive bearing insert. The preform element may be bonded to or partly embedded in a carrier which is received within the socket. The element or carrier may be formed with spaced longitudinal ribs to allow it to be force-fitted into the socket, or the element or carrier may be secured within a hollow sleeve which is formed with such ribs.

17 Claims, 5 Drawing Sheets

FIG 3
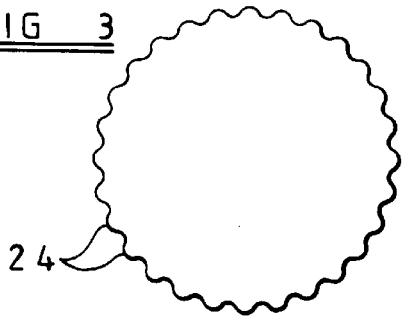
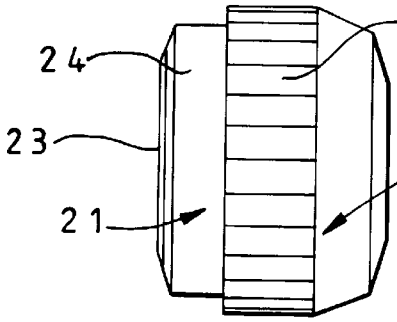
FIG 4
FIG 5
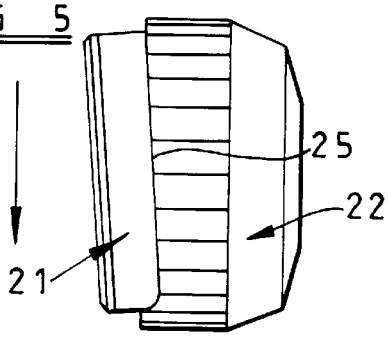
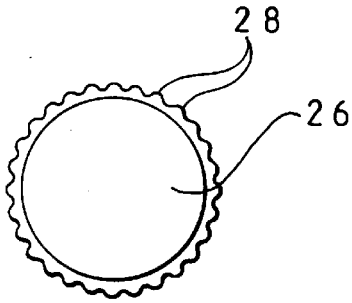
FIG 6
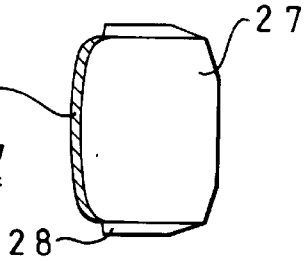
FIG 7
FIG 8
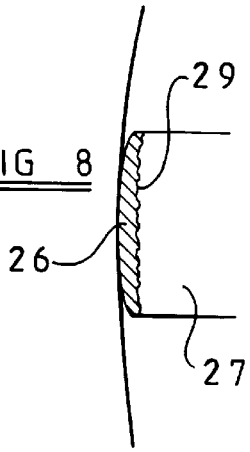
FIG 9
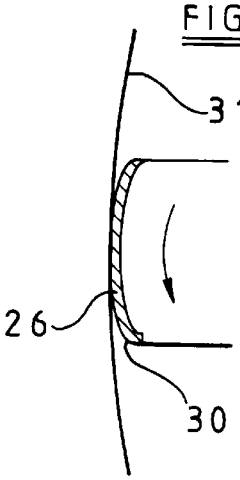
FIG 10
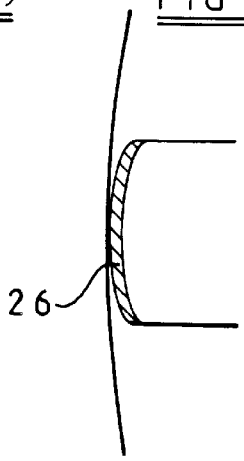
FIG 11
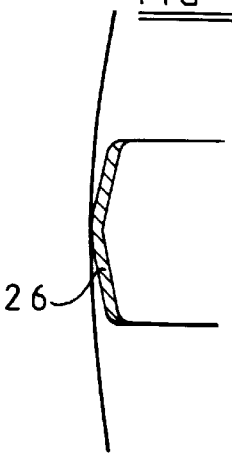

FIG 19
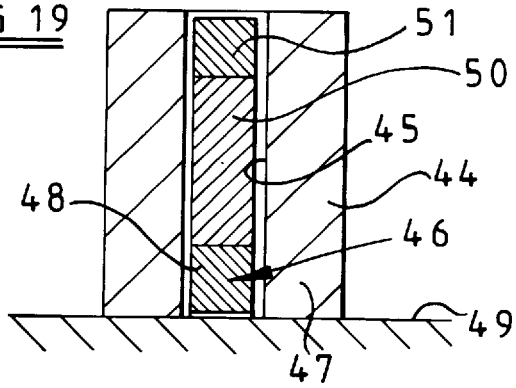
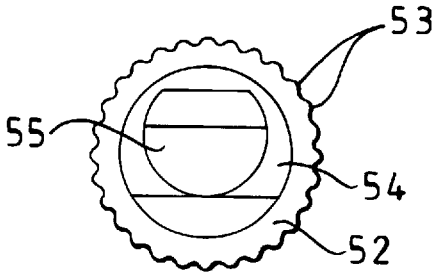
FIG 20
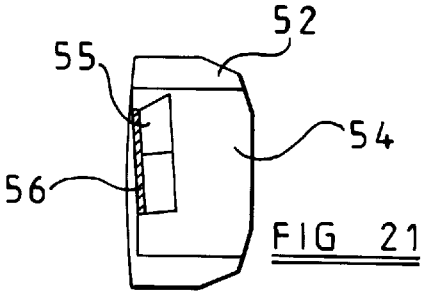
FIG 21
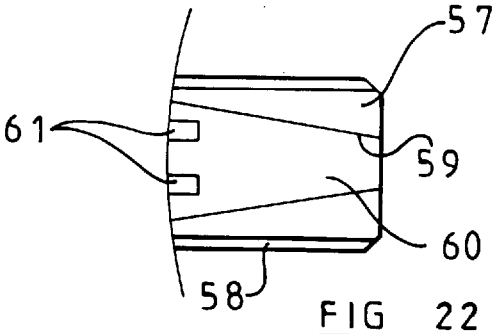
FIG 22
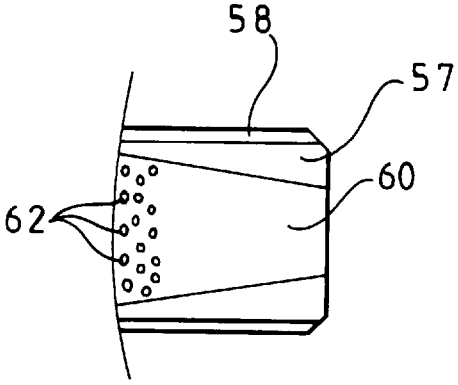
FIG 23
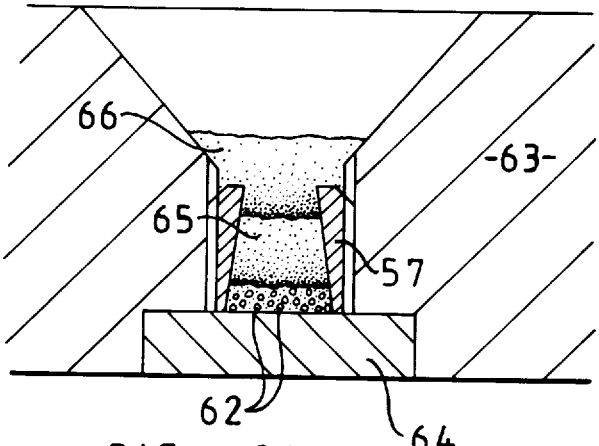
FIG 24

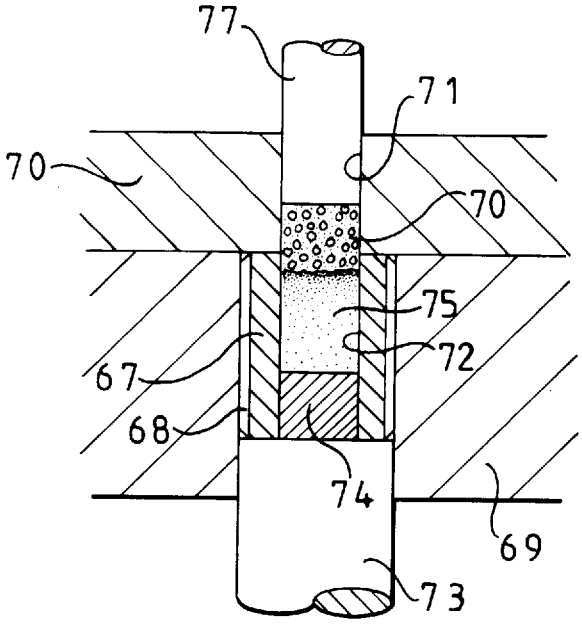
FIG 25
FIG 26
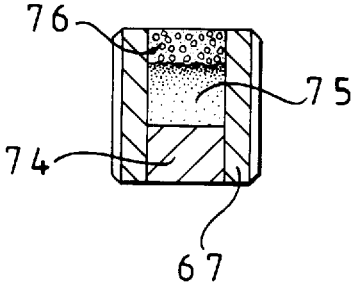
FIG 27
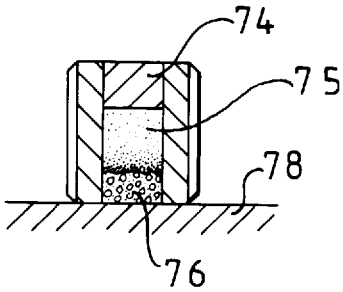
FIG 28
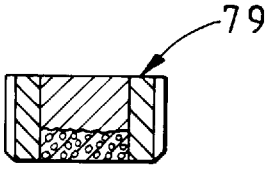
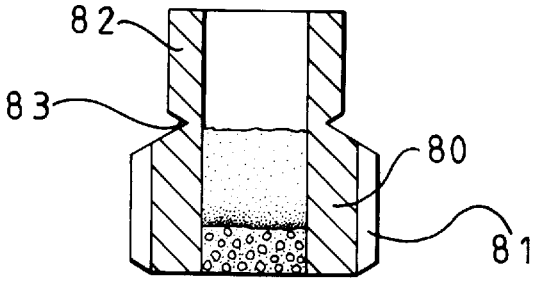
FIG 29

DOWNHOLE COMPONENTS FOR USE IN SUBSURFACE DRILLING

BACKGROUND OF THE INVENTION

1. Field of the Invention

The invention relates to downhole components for use in subsurface drilling in earthen formations and, more particularly but not exclusively, to polycrystalline diamond compact (PDC) drag-type bits.

2. Setting of the Invention

The present invention relates to downhole components of the kind which include at least one bearing pad which, in use, engages the surface of the earthen formation of the borehole, the bearing pad carrying wear-resistant bearing inserts received in sockets in the bearing pad. The invention relates particularly to rotary drag-type drill bits of the kind comprising a bit body having a shank for connection to a drill string and means for supplying drilling fluid to the face of the bit, which carries a plurality of cutting elements, the gauge of the bit including a plurality of gauge pads which, in use, engage the surrounding formation forming the walls of the borehole being drilled, and at least some of said gauge pads carrying bearing inserts received in sockets in the gauge pad.

However, the invention is also applicable to other downhole components where similar bearing inserts are required to prevent wear of the surfaces of the component by abrasion from the formation. For example such bearing pads incorporating bearing inserts may be required on downhole stabilizers, motor or turbine stabilizers, or intermediate bit gauges. For coring bits such bearing inserts may also be advantageous at the internal core gauge of the bit which bears against the central cylindrical core of formation being formed as drilling progresses. Bearing inserts may also be used in modulated bias units for use in steerable rotary drilling systems, for example as described in British Patent Specification No. 2289909. Such bias units include hinged paddles which engage the wall surface of the borehole in order to provide a lateral bias to the bottom hole assembly, and the formation-engaging surfaces of such paddles may have bearing inserts according to the present invention to render them more wear-resistant.

For convenience, however, the present invention will be described with particular reference to polycrystalline diamond compact drag-type drill bits.

One common form of bearing insert used in such bits comprises a circular stud of cemented tungsten carbide, the outer surface of which is substantially flush with the outer surface of the gauge pad. Smaller bodies of natural or synthetic diamond may be embedded in the stud, adjacent its outer surface. In this case the stud may comprise, instead of cemented tungsten carbide, a body of solid infiltrated tungsten carbide matrix material in which the smaller bodies of natural or synthetic diamond are embedded. Such inserts are manufactured by embedding the diamond bodies in powdered tungsten carbide matrix-forming material within a mold. A body of infiltration alloy, normally a copper alloy, is positioned above the compacted tungsten carbide powder in the mold which is then subjected to a high temperature in a furnace so that the alloy fuses and infiltrates downwardly into the particulate material so as to form, upon solidification, a solid body of matrix material in which the diamond is embedded.

Normally, in bearing inserts of any of the above kinds, the circular stud is formed with longitudinally extending ribs or serrations along its outer surface. This enables the insert to be force-fitted into a socket in the gauge pad while allowing for tolerances in the dimensions of the insert or socket. However, such inserts may suffer from two particular disadvantages. Firstly, the exposed diamond at the outer face of the insert may in some formations have too great an abrading effect on the formation, causing undue wearing away of the walls of the borehole in the gauge region of the drill bit. This can lead to instability of the bit in the borehole, for example it may allow the initiation of so-called "bit whirl" in which the rotating bit precesses around the walls of the borehole in the opposite direction to its direction of rotation. The abrasive effect of the inserts may be reduced by using only plain cemented tungsten carbide studs, without the inclusion of diamond bodies. However, such inserts may then be subject to excessive wear in harder formations.

According to one aspect of the present invention, therefore, there are provided in a downhole component, such as a rotary drill bit, bearing inserts which comprise polycrystalline diamond compacts of generally similar form to the compacts which are used as cutting elements on the main cutting face of a drag-type drill bit. Such elements may provide high abrasion resistance while at the same time having a less aggressive abrading effect on the surrounding formation. Although polycrystalline diamond is the material normally used in such elements, other superhard materials, such as cubic boron nitride, may also be employed.

A second disadvantage of the prior art infiltrated matrix bearing inserts is that the ribs or serrations on the outer surface of the inserts may sometimes be partly stripped off, rather than being deformed, and/or deforming the socket, as the insert is force-fitted into its socket. It would therefore be desirable, in order to avoid this, to form the body of the insert from a harder material, and the present invention provides arrangements whereby this may be achieved.

SUMMARY OF THE INVENTION

According to the first aspect of the present invention there is provided a downhole component, for use in the drilling of boreholes in earthen subsurface formations, and of the kind which includes at least one bearing pad which, in use, engages the surface of the earthen formation of the borehole, the bearing pad carrying wear-resistant bearing inserts received in sockets in the bearing pad, characterized in that at least one of said bearing inserts includes a preform element having a front facing table of superhard material having a front face and a rear face bonded to a less hard substrate, at least part of the facing table being exposed at the outer surface of the bearing pad in which the insert is mounted.

The front face of the facing table of the preform element may be substantially flat and orientated to lie in a plane which is substantially tangential to the outer surface of the bearing pad in which the insert is mounted, or is inclined at a small angle to the tangential direction. Alternatively the front face of the preform element may be domed or part-cylindrical. In the latter case the part-cylindrical front face of the preform element is preferably convex and has a radius of curvature, adjacent at least one peripheral edge portion of the element, which is smaller than the radius of curvature of a central portion of said front face.

In any of the above arrangements the preform element may be mounted on the bearing paid by its substrate being directly secured within the socket in the bearing pad. The substrate is preferably generally cylindrical, the socket being of corresponding cylindrical shape. The outer surface of the substrate may be formed with spaced projections to allow it to be force-fitted in the socket. The projections may comprise ribs or serrations extending longitudinally of the substrate. Alternatively the rear surface of the substrate of the preform element may be bonded to a front face of a body of material which is generally cylindrical and is secured within a socket in the bearing pad. In this case the outer surface of the body of material may be formed with spaced projections to allow it to be force-fitted in the socket. In a further alternative arrangement the preform element, comprising the facing table and substrate, may be at least partly embedded in a body of material which is less hard than the superhard material, said body of material in turn being secured within a socket in the bearing pad. The body of material may comprise an infiltrated, sintered, or cemented powdered material formed by a powder metallurgy process. For example, it may comprise cemented tungsten carbide or solid infiltrated matrix material. The outer surface of the body of material in which the preform element is at least partly embedded may be formed with spaced projections to allow the insert to be force-fitted into its socket. The projections may comprise ribs or serrations extending longitudinally of the body of material.

The invention also provides a preform element, for use in a downhole component, comprising a front facing table of superhard material having a front face and a rear face bonded to a less hard substrate, the outer surface of the substrate being formed with spaced projections to allow the insert to be force-fitted into an appropriately sized socket in the downhole component, or the substrate being bonded to a carrier, the outer face of which is formed with such projections. The substrate or carrier is preferably generally cylindrical and the projections comprise ribs or serrations extending longitudinally of the substrate or carrier.

The invention further provides a bearing insert for mounting in a bearing pad of a downhole component, comprising a hollow sleeve within which is secured a preform element comprising a front facing table of superhard material having a front face and a rear face bonded to a less hard substrate, at least a portion of the facing table of the element being exposed at one open end of the sleeve. The preform element may be secured directly within the sleeve by brazing, force-fitting or shrink-fitting, or may be at least partly embedded in a body of less hard material enclosed within the hollow sleeve. For example, the less hard material may be solid infiltrated matrix material.

Preferably the preform element is so orientated with respect to the sleeve that the front face of the preform element extends substantially at right angles to the longitudinal axis of the sleeve, or at a small angle thereto. The invention further provides a bearing insert for mounting in abearing pad of a downhole component, comprising a hollow sleeve within which is secured a body of less hard material within which are embedded one or more smaller bodies of superhard material, at least one of said bodies being exposed at one open end of the sleeve. The smaller bodies comprise polycrystalline diamond, or natural or synthetic diamond. The outer surface of the hollow sleeve may be formed with spaced projections which allow the insert to be force-fitted into its socket. The projections may comprise ribs or serrations extending longitudinally of the hollow sleeve.

The invention includes within its scope a rotary drill bit comprising a bit body having a shank for connection to a drill string and means for supplying drilling fluid to the face of the bit, which carries a plurality of cutting elements, the gauge of the bit including a plurality of gauge pads which, in use, engage the surrounding formation forming the walls of the borehole being drilled, at least some of said gauge pads carrying bearing inserts, of any of the kinds referred to above, received in sockets in the gauge pads.

BRIEF DESCRIPTION OF THE DRAWINGS

FIGS. 3 and 4 are plan and side elevations of one preferred form of bearing element in accordance with the present invention.

FIG. 5 is a side elevation of an alternative preferred form of bearing element.

FIGS. 6 and 7 are plan and sectional views of a further preferred form of bearing element according to the invention.

FIGS. 8–11 are diagrammatic sections through further preferred forms of bearing elements according to the invention.

FIG. 19 illustrates diagrammatically a method of forming a bearing element according to the invention.

FIGS. 20 and 21 are a plan and sectional view of a further preferred form of bearing element according to the invention.

FIGS. 22 and 23 are diagrammatic sectional views of further preferred forms of bearing elements according to the invention.

FIG. 24 illustrates diagrammatically a method of forming bearing elements according to FIGS. 22 and 23.

FIGS. 25–28 illustrate diagrammatically steps in an alternative method of forming bearing elements of the kind shown in FIGS. 22 and 23.

FIG. 29 illustrates a modification of the method shown in FIGS. 25–28.

DETAILED DESCRIPTION OF THE PREFERRED EMBODIMENTS

Figure 1:
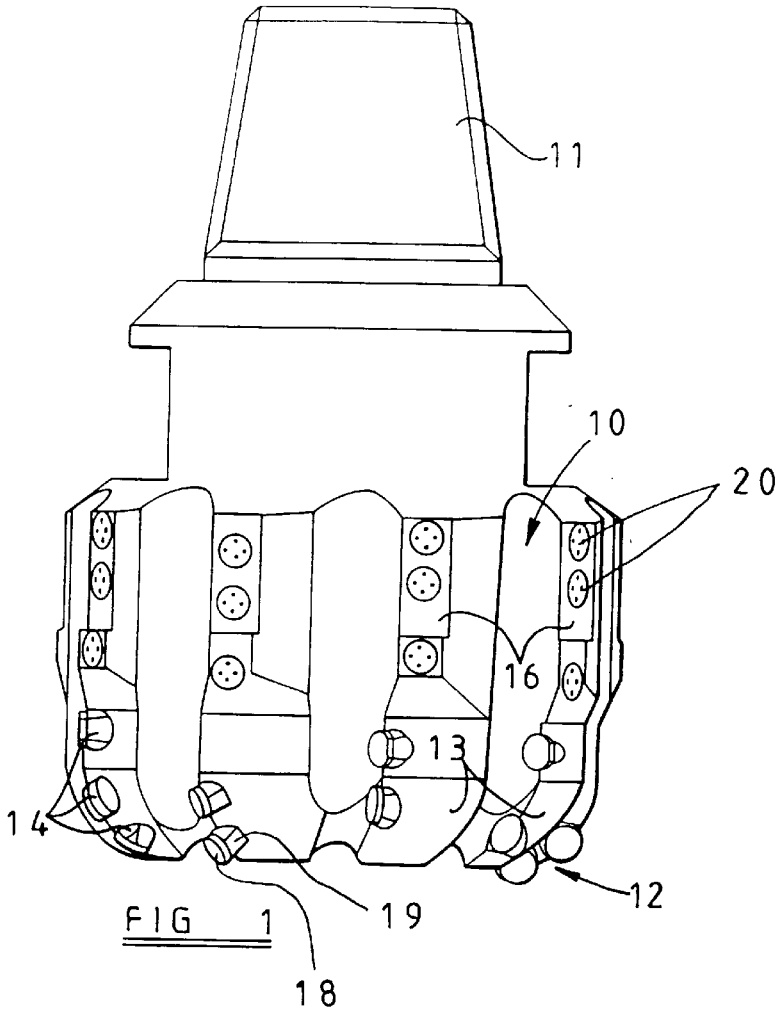
FIG. 1 is a side elevation of a typical drag-type drill bit in which bearing elements according to the present invention may be used.
Figure 2:
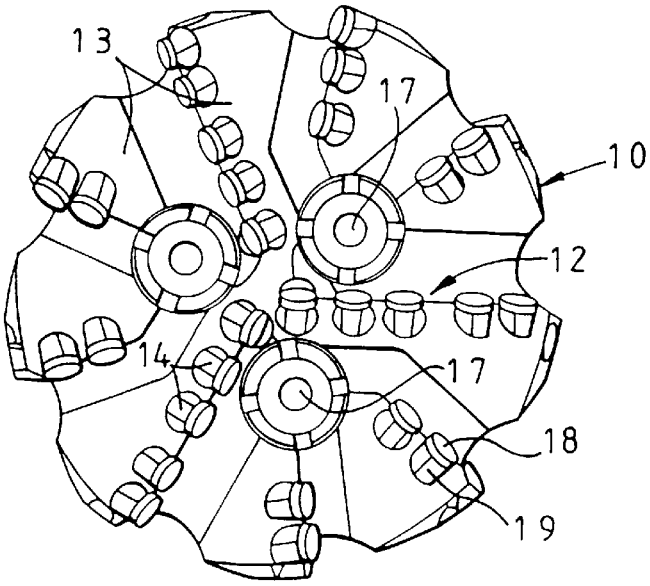
FIG. 2 is an end elevation of the drill bit shown in FIG. 1.

FIGS. 1 and 2 show a typical full bore drag-bit of a kind to which bearing elements of the present invention are applicable. The bit body 10 is machined from steel and has a shank formed with an externally threaded tapered pin 11 at one end for connection to the drill string. The operative end face 12 of the bit body is formed with a number of blades 13 radiating from the central area of the bit, and the blades carry cutters 14 spaced apart along their length thereof. The bit has a gauge section including kickers having gauge pads 16 which contact the walls of the borehole to stabilize the bit in the borehole. A central passage (not shown) in the bit and shank delivers drilling fluid through nozzles 17 in the end face 12 in known manner.

Each cutter 14 comprises a preform cutting element 18 mounted on a carrier 19 in the form of a post which is located in a socket in the bit body. Each preform cutting element is in the form of a circular tablet comprising a facing table of superhard material, usually polycrystalline diamond, bonded to a substrate of less hard material, which is normally cemented tungsten carbide. The rear surface of the substrate is bonded, for example by "LS" bonding, to a suitably orientated surface on the post 19. Bearing inserts 20 are received in sockets in the gauge pads 16. Typically, in prior art arrangements, each insert comprises a short cylinder of cemented tungsten carbide and, in some cases, a number of small diamond bodies may be embedded in the tungsten carbide adjacent the outer surface of the insert. Alternatively, as previously mentioned, the diamond bodies may be embedded in a stud of solid infiltrated tungsten carbide matrix.

The diamond bodies may be of natural or synthetic diamond. In order to accommodate tolerances in the dimensions of the bearing insert and/or socket, each insert is normally formed around its periphery with axially extending ribs or serrations. This enables the insert to be force-fitted into its socket, as a result of deformation of the ribs and/or the walls of the socket.

Although the drill bit described above in relation to FIGS. 1 and 2 is a steel-bodied bit, the invention is equally applicable to bits where the bit body, or outer parts thereof, comprises solid infiltrated matrix material formed by a powder metallurgy process. The general form of construction of such bits is well known and will not be described in detail.

The main purpose of the bearing inserts 20 is to prevent abrasion and wear of the gauge pads 16 which would reduce the stability of the bit in the borehole. However, as previously mentioned, in some softer formations bearing inserts of the prior art kind, and having embedded natural or synthetic diamonds, may be too aggressive and have an undesirable abrading effect on the formation around the walls of the borehole. As a consequence the formation may be worn away by the bearing inserts as drilling proceeds, resulting in an oversize borehole and reducing the stability of the bit in the borehole.

Also, depending on the relative dimensions of a particular insert and its socket, if the bearing insert stud is formed from solid infiltrated matrix, it may occur that the matrix serrations on the insert are partly stripped off as the insert is force-fitted into its socket, instead of the ribs and/or walls of the socket being deformed. The insert may not then be securely retained within its socket and may become detached from the bit body under the stresses to which it is subjected during drilling.

The accompanying drawings show new forms of bearing insert where either or both of the above problems may be reduced or overcome.

FIGS. 3 and 4 illustrate one form of bearing insert according to the invention. The insert comprises a circular preform polycrystalline diamond compact 21 bonded, for example by brazing, to a larger diameter carrier 22. The compact 21 comprises a polycrystalline diamond facing table 23 bonded to a substrate 24 of tungsten carbide, the compact being formed in a high pressure, high temperature press in the usual manner for polycrystalline diamond compacts used as cutting elements on drag-type drill bits of the kind shown in FIGS. 1 and 2. The facing table 23 and the front part of the substrate 24 are chamfered around their periphery, as seen in FIG. 4, to reduce the abrading effect of the compact. A similar effect may also be achieved by applying flat angled chamfers to the leading and trailing edges of the front face of the compact 21, transverse to its direction of movement.

The carrier 22 comprises a cylindrical portion 22*a* formed with axially extending ribs or serrations 22*b* so that the insert may be force-fitted within an appropriately sized socket in the gauge pad. The insert is pressed into the socket so that the front face of the facing table 23 is substantially flush with the surface of the gauge pad or is very slightly proud of that surface. The front face of the facing table 23 extends at right angles to the longitudinal axis of the insert and therefore extends generally tangentially to the curved surface of the gauge pad.

The insert thus forms a bearing surface on the gauge pad which is highly resistant to abrasion, but since it comprises a flat surface of comparatively large area extending tangentially to the surface of the gauge pad, and hence to the formation, the insert does not exert a great abrading effect on the formation. Also, since the carrier 22 may be formed of material, such as cemented tungsten carbide, which is harder than solid infiltrated tungsten carbide matrix material, any tendency for the ribs 22*b* to be stripped off as the insert is forced into its socket is reduced or eliminated.

In some cases it may be desirable for the bearing insert to have an even lesser abrading effect on the formation and this may be achieved by mounting the preform compact 21 at a slight angle on the carrier 22, and such an arrangement is shown in FIG. 5. In this case the carrier 22 is formed with an inclined surface 25 to which the rear surface of the preform compact 21 is brazed. The direction of movement of the insert, during drilling, is indicated by the arrow.

Instead of the polycrystalline diamond compact being mounted on a carrier which is received in a socket in the gauge pad, the substrate itself of the compact may be of sufficient axial length that it may be secured within the socket without the necessity of mounting the compact on a carrier. Such an arrangement is shown in FIGS. 6 and 7 where the front facing table of the compact is indicated at 26 and the tungsten carbide substrate is indicated at 27. It will be seen that in this arrangement the polycrystalline diamond facing table is slightly domed and rounded at its peripheral edge to reduce even further its abrasive effect on the formation. Alternatively, the facing table might be part-cylindrical in shape, i.e., its front surface may be generally straight as viewed in sections at right angles to the section shown in FIG. 7.

In this case the outer periphery of the cylindrical substrate 27 itself is formed with axially extending ribs or serrations 28 to enable the substrate to be force-fitted into an appropriately sized socket in the gauge pad. Again, since the substrate and ribs 28 are formed from the comparatively hard cemented tungsten carbide, there is less risk of the ribs being stripped off as the insert is forced into its socket.

FIGS. 8 to 11 are diagrammatic sectional views showing various alternative configurations for the polycrystalline diamond facing table 26. In the arrangement of FIG. 8 the outer surface of the facing table 26 is convexly domed and the interface 29 between the facing table 26 and the substrate 27 is non-planar so as to improve the bond between the facing table and substrate.

In the arrangement of FIG. 9 the outer face of the facing table 26 is not domed but is part-cylindrical, that is to say the surface is generated by parallel straight lines extending parallel to the axis of rotation of the drill bit. The part-cylindrical surface of the facing table 26 is more sharply curved, at a smaller radius, as indicated at 30, on the leading side of the direction of movement of the insert relative to the formation 31. This, again, reduces the abrading effect of the insert on the formation.

FIG. 10 is a similar view of an arrangement where the outer face of the facing table 26 is also part-cylindrical, but in this case the radius of curvature of the part-cylindrical surface is reduced at both sides of the element, adjacent its periphery.

FIG. 11 shows a domed arrangement where the domed surface of the facing table is generally in the form of a shallow cone with a rounded periphery.

Instead of the polycrystalline diamond compact being mounted on the surface of a carrier, as shown in FIGS. 3–5, it may be partly embedded in a body of material forming the carrier, as in the embodiments of FIGS. 12–15.

Figure 12:
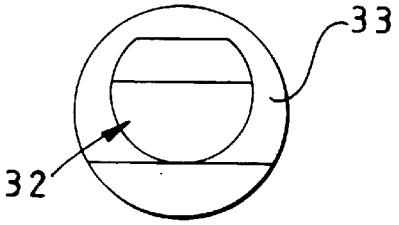
FIGS. 12–17 are plan and sectional views of other preferred forms of bearing element according to the invention.
Figure 13:
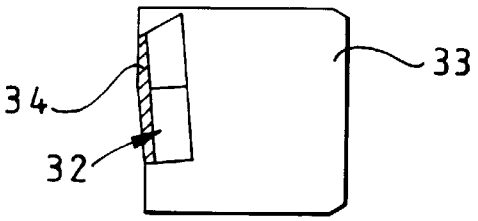

Referring to FIGS. 12 and 13, a part-circular two-layer polycrystalline diamond compact 32 is embedded adjacent the surface of a generally cylindrical body of material 33. The body 33 is formed from solid infiltrated matrix which is infiltrated at a temperature insufficient to cause significant thermal degradation of the preform compact 32. The compact 32 is so mounted within the body of material 33 that the front surface of the facing table 34 of the compact is exposed at one end of the body of material 33. In use, the cylindrical body 33 is received in a socket in the gauge pad with the exposed surface of the compact 32 substantially flush with the outer surface of the gauge pad. As in the arrangement of FIG. 5, the compact is slightly angled to reduce its abrading effect on the formation.

Figure 14:
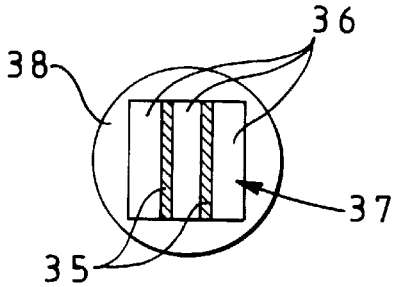
Figure 15:
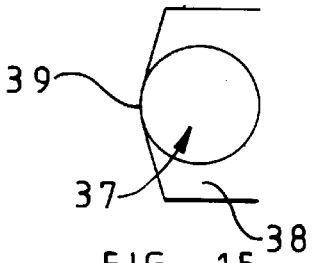

In the alternative arrangement shown in FIGS. 14 and 15 the polycrystalline diamond compact comprises two layers 35 of polycrystalline diamond sandwiched between three layers 36 of tungsten carbide to form a generally cylindrical compact 37 of circular cross-section. The compact 37 is embedded adjacent one end of a cylindrical body 38 of solid infiltrated matrix material and the axis of the compact 37 extends at right angles to the longitudinal axis of the body 38 so that parts of the peripheral edges of the diamond layers 35 are exposed at the end surface of the body 38, as indicated at 39 in FIG. 15. These exposed portions of the compact 37 bear on the formation.

The arrangements of FIGS. 12 and 15 are not shown as having axial longitudinal ribs on the outer surface of the main body 33 or 38, but such ribs may be provided, for example in the initial molding of the body of material or by subsequent machining. Similarly, although the arrangements of FIGS. 3–7 are shown as providing longitudinal ribs or serrations on the bearing insert, in a modification thereof such ribs are not provided in which case the inserts may be secured within their respective sockets by brazing or shrink-fitting.

Figure 16:
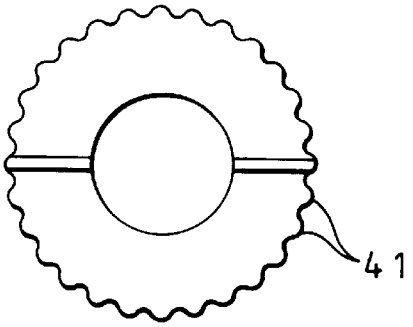
Figure 17:
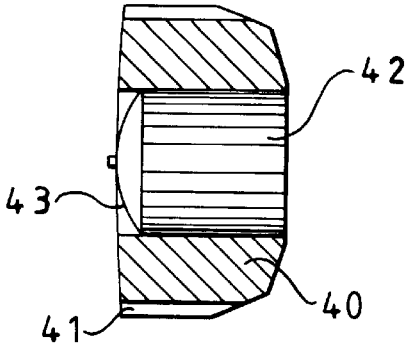

In the alternative arrangement shown in FIGS. 16 and 17 the bearing insert comprises a hollow generally cylindrical sleeve 40 formed around its periphery with spaced parallel axially extending ribs 41. Although the sleeve 40 may be formed from solid infiltrated matrix material, it is preferably formed from a harder material, such as cemented tungsten carbide, to allow force-fitting of the insert into a socket in the gauge pad without risk of the ribs 41 being stripped off as the insert is introduced into the socket.

Secured within the sleeve 40, for example by brazing, is a preform polycrystalline diamond compact comprising an elongate cylindrical substrate 42 of cemented tungsten carbide bonded to one end of which is a facing layer 43 of polycrystalline diamond. The end face of the substrate 42 is domed so that the outer face of the diamond layer 43 is also domed, the top of the dome coming substantially flush with the end surface of the sleeve 40.

Figure 18:
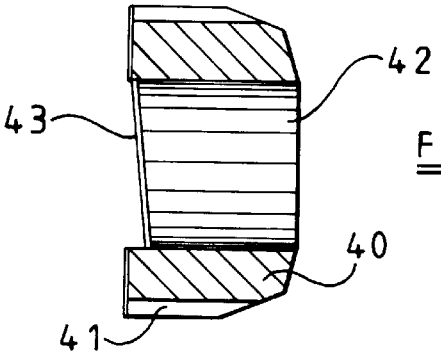
FIG. 18 is a sectional view of a further preferred form of bearing element.

In the modified embodiment shown in FIG. 18, the end face of the substrate 42 is inclined to the longitudinal axis of the preform so that the outer face of the diamond layer 43 is inclined with respect to the tangential direction at the outer face of the insert. In the arrangement of FIGS. 16–18 the substrate 42 of the polycrystalline diamond compact is of sufficient length to extend through substantially the whole length of the sleeve 40. However, in the case where the compact is of lesser length than the sleeve 40 a carrier or support block may be mounted within the sleeve 40 to the rear of the polycrystalline diamond compact. FIG. 19 shows a method of manufacturing such an insert.

Referring to FIG. 19: there is first provided a tungsten carbide hollow cylindrical sleeve 44 formed with an axial through bore 45. A polycrystalline diamond compact 46 comprising a diamond facing table 47 and a tungsten carbide substrate 48 is inserted into the bore 45 so as to be positioned face down on a suitable surface 49. Above the compact 46 is located a tungsten carbide body 50, which may comprise a solid cylindrical body of tungsten carbide or a plurality of parallel tungsten carbide rods. Above the tungsten carbide 50 is located a slug 51 of braze alloy. The assembly is then introduced into a furnace so that the braze alloy 51 fuses and infiltrates downwardly so as to braze the compact 46 and body 50 in position within the sleeve 44. After solidification the insert is cut to length if required.

Instead of the compact 46 being backed up by a separate body 50 of tungsten carbide, in some cases the substrate 48 of the compact may be of sufficient axial length so as to fill the sleeve entirely, in which case the extra body of tungsten carbide material 50 may be omitted.

In the arrangements of FIGS. 16–19, the preform compact extends across substantially the whole diameter of the internal bore in the sleeve. However, this is not essential, and FIGS. 20 and 21 show an arrangement where the preform compact is partly embedded in a body of material within the sleeve. In this arrangement the sleeve 52, formed with longitudinal ribs 53, is formed, for example by moulding, from cemented tungsten carbide. Filling the sleeve 52 is a body 54 of solid infiltrated tungsten carbide matrix material in one end of which is embedded a polycrystalline diamond compact 55. The front surface of the facing table 56 of the compact is exposed at one end of the insert.

The matrix material 54 is a low temperature matrix material, that is to say it is a material which is infiltrated at a temperature which is insufficient to cause significant thermal degradation of the polycrystalline diamond compact 55. The harder cemented tungsten carbide of the sleeve 52 ensures that the risk of the ribs 53 being stripped off as the insert is force-fitted into its socket is reduced or eliminated.

The arrangement employed in FIGS. 20 and 21 for mounting a two-layer polycrystalline diamond compact on a bearing insert may also be employed in the manufacture of bearing inserts where the abrasion-resistant elements are, more conventionally, natural or synthetic diamond particles. Thus, as shown in FIG. 22, the bearing insert may comprise a generally cylindrical cemented tungsten carbide sleeve 57 formed with external longitudinal ribs 58. In this case the central passage 59 within the sleeve tapers inwardly from the outer end thereof. The passage 59 is filled with a body of solid infiltrated tungsten carbide matrix material 60 in which small rectangular blocks 61 of natural or polycrystalline diamond are embedded adjacent the outer end of the sleeve so that the surfaces of the block 61 are exposed to the formation.

The sleeve 57 is formed by power metallurgy from tungsten carbide or similar hard material so as to provide resistance to stripping off of the ribs 58 during insertion. The matrix material 60 is of a kind which is infiltrated as a temperature insufficient to cause significant thermal degradation to the diamond blocks 61. However, the blocks 61 may be of natural diamond or of so-called thermally stable diamond material and thus able to withstand high infiltration temperatures.

FIG. 23 shows a similar but modified bearing insert in which there is embedded in the infiltrated matrix 60 a number of natural diamonds 62 adjacent the outer end face of the insert. FIG. 24 illustrates a method of manufacturing bearing inserts of the kind shown in FIGS. 22 and 23. The preformed hard metal serrated sleeve 57 is located in a suitably shaped mould 63. Natural or synthetic diamonds 62 suspended in a wet mix of matrix-forming material are packed into the lower end of the sleeve 57 on a sealing plug 64. Powdered matrix-forming material, such as powdered tungsten carbide, 65 is packed above the diamond layer and a body 66 of infiltrant alloy in powder form, for example nickel brass or other infiltrant, is packed above the matrix powder 65.

The mold assembly is then placed in a furnace so that the infiltrant alloy 66 fuses and infiltrates downwardly into the matrix powder 65 and diamond suspension so as to form a solid infiltrated matrix, within which the diamonds 62 are suspended, within the sleeve 57. Upon removal from the mould the sleeve 57 is cut to the required axial length if necessary. The mould 63, which may be formed from graphite, may then be re-used. The method of forming the insert of the kind shown in FIG. 22 is similar, except that the surface set diamond blocks 61 are merely placed on the sealing plug 64 before the matrix-forming powder 65 is introduced into the sleeve 57.

It will be appreciated that the method described in relation to FIG. 24 may also be employed, with suitable modifications, to manufacture a bearing insert of the kind shown in FIGS. 20 and 21.

FIGS. 25–28 illustrate an alternative method of forming inserts comprising a separate outer sleeve. In this method the sleeve 67 formed with external longitudinal ribs 68 is supported within a cylindrical bore in a die 69 over which is supported a loose fill plate 70 having a bore 71 which registers with the central cylindrical bore 72 in the sleeve 67. The sleeve 67 is supported on a cylindrical ejector plug 73.

A cylindrical plug 74 of infiltrant alloy is first introduced into the bottom of the sleeve 67 so as to rest on the ejector plug 73 and the sleeve 67, above the alloy 74, is then loosely packed with matrix-forming tungsten carbide powder 75 and a suspension 76 of diamonds in a paste of matrix powder. The materials are then compressed downwardly into the sleeve 67 by means of a cylindrical compression punch 77 which is a sliding fit in the bore 71.

The fill plate 70 is then removed and the filled sleeve 67 (see FIG. 26) is then ejected from the support die 69 by upward movement of the ejector plug 73. The filled die 67 is then inverted on to a graphite plate 78 (see FIG. 27) and placed in a furnace so that the alloy 74 fuses and infiltrates downwardly into the matrix material 75 and 76. After solidification the assembly is then cut to length to produce the finished bearing insert 79, as shown in FIG. 28.

FIG. 29 shows an alternative shape for the sleeve to facilitate cutting the insert to the required length after infiltration. In this case the sleeve comprises a lower portion 80 of the required ultimate length, formed with external longitudinal ribs 81, and a thinner-walled portion 82, without ribs, extends upwardly from the portion 80. The junction between the upper portion 82 and the lower portion 80 is reduced in wall thickness, as indicated at 83, to facilitate separation of the upper portion from the main insert portion 80 after infiltration has been completed.

In the arrangements described above where a polycrystalline diamond compact is employed in the bearing insert, the compact is shown as a two-layer compact comprising a facing table of polycrystalline diamond or other superhard material bonded, in the press, to a substrate of a less hard material such as cemented tungsten carbide. However, the invention also includes within its scope modified versions of such embodiments in which the polycrystalline diamond compact, instead of being a two-layer compact, comprises a single layer of polycrystalline diamond material formed in the press as a unit without being at the same time bonded to a substrate. Such single layer polycrystalline diamond compacts will usually comprise so-called thermally stable polycrystalline diamond preforms, which may be subjected to higher temperatures than two-layer preforms without suffering significant thermal degradation.

Whereas the present invention has been described in particular relation to the drawings attached hereto, it should be understood that other and further modifications, apart from those shown or suggested herein, may be made within the scope and spirit of the present invention.

What is claimed is:

1. A bearing insert for mounting in a bearing pad of a downhole component, comprising a hollow sleeve within which is secured a single body of less hard material which is coaxial with the sleeve and within which single body are embedded a number of smaller bodies of superhard material, at least one of said smaller bodies being exposed at one open end of the sleeve.

2. A bearing insert according to claim 1, wherein said smaller bodies comprise polycrystalline diamond.

3. A bearing insert according to claim 1, wherein said smaller bodies comprise natural or synthetic diamond.

4. A downhole component, for use in the drilling of boreholes in earthen subsurface formations, and of the kind which includes at least one bearing pad which, in use, engages the surface of the earthen formation of the borehole, the bearing pad carrying wear-resistant bearing inserts received in sockets in the bearing pad, and at least one of said bearing inserts including a preform element having a front facing table of superhard material having a front face and a rear face bonded to a less hard substrate, at least part of the facing table being exposed at the outer surface of the bearing pad in which the insert is mounted, said front face of the preform element being part-cylindrical and convex and having a radius of curvature, adjacent at least one peripheral edge portion of the element, which is smaller than the radius of curvature of a central portion of said front face.

5. A downhole component, for use in the drilling of boreholes in earthen subsurface formations, and of the kind which includes at least one bearing pad which, in use, engages the surface of the earthen formation of the borehole, the bearing pad carrying wear-resistant bearing inserts received in sockets in the bearing pad, and at least one of said bearing inserts including a preform element having a front facing table of superhard material having a part-cylindrical convex front face and a rear face bonded to a less hard substrate, at least part of the part-cylindrical front face of the facing table being exposed at the outer surface of the bearing pad in which the insert is mounted.

6. A rotary drill bit comprising a bit body having a shank for connection to a drill string and means for supplying drilling fluid to the face of the bit, which carries a plurality of cutting elements, the gauge of the bit including a plurality of gauge pads which, in use, engage the surrounding formation forming the walls of the borehole being drilled, at least some of said gauge pads carrying bearing inserts received in sockets in the gauge pads, at least one of said bearing inserts including a preform polycrystalline diamond compact having a front facing table of polycrystalline diamond material having a front face and a rear face bonded to a less hard substrate, the substrate being bonded to a carrier, the outer face of the carrier being formed with spaced projections which are force-fitted into a socket in the downhole component, the polycrystalline diamond compact having been preformed by bonding the facing table and substrate together in a high pressure, high temperature press prior to inclusion of the polycrystalline diamond compact in the preform element.

7. A rotary drill bit comprising a bit body having a shank for connection to a drill string and means for supplying drilling fluid to the face of the bit, which carries a plurality of cutting elements, the gauge of the bit including a plurality of gauge pads which, in use, engage the surrounding formation forming the walls of the borehole being drilled, at least some of said gauge pads carrying bearing inserts received in sockets in the gauge pads, at least one of said bearing inserts including a hollow sleeve within which is secured a single body of less hard material which is coaxial with the sleeve and within which single body are embedded a number of smaller bodies of superhard material, at least one of said smaller bodies being exposed at one open end of the sleeve.

8. A downhole component, for use in the drilling of boreholes in earthen subsurface formations, and of the kind which includes at least one bearing pad which, in use, engages the surface of the earthen formation of the borehole, the bearing pad carrying wear-resistant bearing inserts received in sockets in the bearing pad, and at least one of said bearing inserts including a preform polycrystalline diamond compact having a front facing table of polycrystalline diamond material having a front face and a rear face bonded to a less hard substrate, at least part of the facing table being exposed at the outer surface of the bearing pad in which the insert is mounted, the polycrystalline diamond compact having been preformed by bonding the facing table and substrate together in a high pressure, high temperature press prior to inclusion of the polycrystalline diamond compact in the bearing insert, and the front face of the preform element being domed.

9. A downhole component, for use in the drilling of boreholes in earthen subsurface formations, and of the kind which includes at least one bearing pad which, in use, engages the surface of the earthen formation of the borehole, the bearing pad carrying wear-resistant bearing inserts received in sockets in the bearing pad, and at least one of said bearing inserts including a preform polycrystalline diamond compact having a front facing table of polycrystalline diamond material having a front face and a rear face bonded to a less hard substrate, at least part of the facing table being exposed at the outer surface of the bearing pad in which the insert is mounted, the polycrystalline diamond compact having been preformed by bonding the facing table and substrate together in a high pressure, high temperature press prior to inclusion of the polycrystalline diamond compact in the bearing insert, and the rear surface of the substrate of the preform element being bonded to a front face of a body of material which is generally cylindrical and is secured within a socket in the bearing pad.

10. A downhole component according to claim 9, wherein the body of material comprises an infiltrated, sintered, or cemented powdered material formed by a powder metallurgy process.

11. A downhole component according to claim 9, wherein the body of material is a force-fit in the socket and the outer surface of the body of material is formed with spaced projections to allow it to be force-fitted.

12. A downhole component, for use in the drilling of boreholes in earthen subsurface formations, and of the kind which includes at least one bearing pad which, in use, engages the surface of the earthen formation of the borehole, the bearing pad carrying wear-resistant bearing inserts received in sockets in the bearing pad, and at least one of said bearing inserts including a preform polycrystalline diamond compact having a front facing table of polycrystalline diamond material having a front face and a rear face bonded to a less hard substrate, at least part of the facing table being exposed at the outer surface of the bearing pad in which the insert is mounted, the polycrystalline diamond compact having been preformed by bonding the facing table and substrate together in a high pressure, high temperature press prior to inclusion of the polycrystalline diamond compact in the bearing insert, and the preform element, comprising the facing table and substrate, being at least partly embedded in a body of material which is less hard than the superhard material, said body of material in turn being secured within a socket in the bearing pad.

13. A downhole component according to claim 12, wherein the material is selected from cemented tungsten carbide or solid infiltrated matrix material.

14. A downhole component according to claim 12, wherein the outer surface of the body of material in which the preform element is at least partly embedded is formed with spaced projections to allow the insert to be force-fitted into its socket.

15. A downhole component according to claim 14, wherein the projections comprise ribs or serrations extending longitudinally of the body of material.

16. A bearing insert for mounting in a bearing pad of a downhole component, comprising a hollow sleeve within which is secured a preform polycrystalline diamond compact comprising a front facing table of polycrystalline diamond material having a front face and a rear face bonded to a less hard substrate, at least a portion of the facing table of the compact being exposed at one open end of the sleeve, the polycrystalline diamond compact having been preformed by bonding the facing table and substrate together in a high pressure, high temperature press prior to inclusion of the polycrystalline diamond compact in the bearing insert, the preform element being at least partly embedded in a body of less hard material enclosed within the hollow sleeve.

17. A bearing insert according to claim 16, wherein the less hard material is solid infiltrated matrix material.

* * * * *